US006474096B1

(12) United States Patent
de la Guardia

(10) Patent No.: US 6,474,096 B1
(45) Date of Patent: Nov. 5, 2002

(54) REMOVABLE DEVICE FOR COOLING A BEVERAGE IN A CONTAINER

(76) Inventor: Mario Felix de la Guardia, 13211 SW. 39 Ter., Miami, FL (US) 33175

( * ) Notice: Subject to any disclaimer, the term of this patent is extended or adjusted under 35 U.S.C. 154(b) by 0 days.

(21) Appl. No.: 09/707,152

(22) Filed: Nov. 6, 2000

(51) Int. Cl.[7] ..... F25D 3/08
(52) U.S. Cl. ..... 62/457.3; 62/530
(58) Field of Search ..... 62/457.3, 457.1, 62/457.4, 371, 438, 529, 530; 220/709, 739

(56) References Cited

U.S. PATENT DOCUMENTS 2,075,137 A * 3/1937 Rosen
5,148,688 A * 9/1992 Pimm et al. ..... 62/457.3
5,189,892 A * 3/1993 Roberts ..... 62/457.3 X
5,799,501 A * 9/1998 Leonard et al. ..... 62/457.3

* cited by examiner

*Primary Examiner*—Chen-Wen Jiang

(57) ABSTRACT

A beverage cooling device includes a main body defined by an impermeable membrane wall surrounding and encapsulating a sealed interior chamber which is filled with a freezable material. The membrane wall is structured and disposed to permit heat transfer between a liquid beverage surrounding the main body and the frozen material contained within the interior chamber. A suction cup, fixed and integral with the bottom of the main body, permits removable attachment of the device to the inside base of a drinking vessel which is subsequently filled with the beverage. At least one flexible appendage connects between an outside rim of the suction cup and the main body to permit easy removal of the device from the drinking vessel by pushing the top of the main body in a side to side manner so that the one or more flexible appendages pull and lift on the outside rim of the suction cup, thereby compromising the vacuum seal between the suction cup and the drinking vessel and releasing the device. Accordingly, after the beverage is consumed, the entire device can be removed from the drinking vessel, properly washed, and placed in the freezer until the next use.

4 Claims, 2 Drawing Sheets

REMOVABLE DEVICE FOR COOLING A BEVERAGE IN A CONTAINER

BACKGROUND OF THE INVENTION

1. Field of the Invention

This invention relates to cooling devices for beverages, and particularly to reusable cooling devices that are frozen and then removably attached to the inside base of a drinking vessel to cool a beverage contained therein.

2. Description of the Related Art

The most common method used to cool a beverage or to maintain a cold beverage temperature is to place one or more frozen cubes of ice directly in the beverage. While this is certainly an effective beverage cooling method placing ice cubes in a beverage does present some problems. Specifically, when the frozen ice cubes melt, the beverage becomes diluted with water. This diminishes the beverage taste and sacrifices beverage quality. In order to overcome this problem, various beverage cooling devices have been developed in the related art. In particular, a number of known beverage cooling devices propose using a frozen liquid within a sealed housing or body. In most instance, the wall of the sealed body is composed of an impermeable membrane which permits heat transfer between the beverage and the frozen liquid inside of the sealed body. As the frozen liquid melts, the impermeable membrane wall of the sealed body will contain the melted liquid and not allow the beverage to become diluted.

The U.S. patent to Leonard, et al., U.S. Pat. No. 5,799,501, discloses a beverage cooling apparatus having a body with a sealed hollow interior. A freezable material is filled within the hollow interior and is completely sealed within the body so that it cannot leak therefrom. A suction cup is threadably attached to the bottom of the body and a first ring, constructed of insulating material, encompasses the top of the body.

One major drawback of the Leonard, et al. beverage cooling device is the lack of any means for easy removal of the suction cup from the base of the vessel. To illustrate further, in order to remove the Leonard device from the bottom of a drinking vessel, a user must first manually unscrew the sealed freezable body and then separate it from the suction cup. After separating the freezable sealed body from the suction cup, the suction cup remains attached to the base of the vessel. The suction cup must then be removed by reaching inside of the drinking vessel and pulling on a tab extending from the suction cup.

It is well known that a suction cup that is attached to a smooth surface, such as the base of a glass or smooth plastic drinking vessel, is difficult to remove. As exemplified in the Leonard, et al. patent disclosure, the common method for suction cup removal is to manually pull up on an extending tab in order to compromise the seal between the suction cup and surface, thereby breaking the vacuum under the suction cup and causing the suction cup to release from the surface.

In U.S. Pat. No. 5,799,501, Leonard, et al. state that one object of the invention is to "provide a beverage cooling device that is used within a pitcher or other similar open topped container." This implies that the invention of Leonard, et al. is designed for use with a pitcher, or a like container having a large opening and containing a large hollow cavity. It is obvious that a small vessel with a narrow opening will introduce a problem when attempting the manual removal of the suction cup by reaching to the bottom of the vessel and pulling a tab. Indeed, it may be difficult to reach the tab if the vessel is deep and narrow. In some instances, a user would have to pick at the tab of the suction cup with one finger in order to lift up the outside corner flap of the suction cup. In other cases, a user's hand and/or fingers will not fit between the body of the cooling device and the side of the vessel in attempting to reach the bottom; particularly if the vessel is somewhat small or narrow (e.g., a cup, mug or drinking glass). The user would then be required to use an alternative device to pick at the suction cup in an attempt to lift up the corner flap. Thus, a tool or pick shaped device or the like would have to be utilized to pry off the suction cup stuck on the bottom of a small drinking vessel. This method of suction cup removal is inconvenient, clumsy, and time consuming. In U.S. Pat. No. 5,799,501, Leonard, et al. further disclose pivot means located on the stem of the suction cup to permit back and forth pivoting of the body relative to the suction cup. This further demonstrates that the invention as disclosed by Leonard, et al. is designed to pivot back and forth and still remain attached to the base of a drinking vessel. As illustrated in FIG. 5 in the drawing sheets of U.S. Pat. No. 5,799,501, the pivot action makes the disclosed invention difficult to remove from the base of a drinking vessel. Thus, manually pushing the Leonard, et al. cooling device from side to side on the top of the body will not remove the device, and particularly the suction cup, from the base of a drinking vessel.

The beverage cooling device of Leonard, et al. presents a further problem with regards to cleanliness and safe hygiene. Specifically, the threaded engagement of the suction cup to the body may allow a beverage to seep in between the female and male threads. Threaded parts that are not properly sealed are common breeding grounds for various bacteria. As the Leonard, et al. beverage cooling device is submerged in a vessel containing a consumable beverage, the beverage may seep between the male and female threads. The freezable sealed body should be separated from the suction cup for proper cleaning after use. Thus, the Leonard, et al. device should be disassembled into two parts prior to proper cleaning. This is undesirable because it is time consuming and parts may get lost during the cleaning process.

With some beverage cooling devices, the entire vessel must be placed in a refrigerator. For instance, U.S. Pat. No. 5,970,737 to Downey discloses a freezer pitcher comprising a container having an open top with a generally annular interior wall and a generally annular exterior wall radially spaced apart to form a cavity therebetween. A freezable liquid is disposed within the cavity for maintaining the container at a cool temperature for a determinable time interval, so as to keep a beverage placed within the container cool. This is undesirable because the entire freezer pitcher will occupy a large volume of space when stored in a household refrigerator.

Other beverage cooling devices in the related art employ a two-part design that includes a cooling insert that works in combination with a specially designed vessel. In U.S. Pat. No. 5,609,039 to Green, et al., a cooling cartridge is used in combination with a drinking bottle. Likewise in the U.S. Pat. No. 5,597,087 to Vinarsky, a thermal chiller pack fits into the bottle interior via a bottom wall opening, and is removably sealed as a unit in the bottle. Also, in the U.S. Pat. No. 5,467,877 to Thomas, a baby bottle with recessed bottom for the removable receipt of a cold substance is disclosed. U.S. Pat. No. 5,189,892 to Roberts discloses a container that keeps liquids cold includes an upstanding hollow post that defines an upstanding cavity having an open end at the lowermost end of the container. A frozen plug is inserted into the cavity from the lowermost end and locked into place. Likewise, U.S. Pat. No. 4,580,405 to Cheng discloses a cold-preserving cup mounting comprising a first mid-hollow cup and a second hollow stick. The hollow stick is firmly screwed to the mid-hollow cup from the bottom hole. This arrangement permits anyone to enjoy chilly drinks provided the hollow stick is first refrigerated before being screwed into the mid-hollow cup. Finally, in U.S. Pat. No. 5,044,173 to Pimm, et al., a drinking vessel is disclosed, wherein an ice container mounts within the vessel for cooling the vessel contents without diluting the contents. Alternatively, a heat chamber for burning fuel serves to heat the vessel contents. The ice container is removably mounted in the vessel by magnetic members, or by snap engaging members, or by mating threads on the vessel and the container. One major drawback with a device which combines a cooling insert with a specially designed container is that the cooling insert is not universal and thus cannot be used with any standard drinking vessel, pitcher, mug or cup.

OBJECTS AND ADVANTAGES OF THE INVENTION

With the foregoing in mind, it is the principle object of the present invention to provide an improved beverage cooling device including: a main body filled with a freezable material; a suction cup fixedly attached to the main body for releasably attaching the device to an inner surface of a fluid carrying vessel; and means for breaking a vacuum seal between the suction cup and inner surface of the vessel by manipulating the main body, thereby allowing for release and removal of the device from the vessel, as a one-piece integral unit, without having to reach deep into the vessel in order to pry the suction cup free.

Another object of the present invention is to provide an improved beverage cooling device including a body containing a freezable substance and a suction cup permanently attached to the bottom of the sealed body for providing means to attach the sealed body and suction cup to the bottom of a drinking vessel by exerting force in a downward motion to the top of the sealed body and thereby causing the suction cup to depressurize to form a vacuum between the suction cup and the bottom of the drinking vessel.

A further object of the present invention is to provide an improved beverage cooling device having means for easy removal of the sealed body and suction cup from the base of the vessel as an integral unit.

Yet another object of the present invention is to provide an improved beverage cooling device which is manufactured as a one-piece integral unit, thereby providing means for easy washing and proper hygiene without the possibility of losing separated parts.

Still another object of the present invention is to provide an improved beverage cooling device that is compact and small in size to order to efficiently occupy a minimal amount of space in a refrigerator or freezer during the freezing process.

SUMMARY OF THE INVENTION

The present invention is directed to a beverage cooling device and includes a main body defined by an impermeable membrane wall surrounding and encapsulating a sealed interior chamber which is filled with a freezable material. The membrane wall is structured and disposed to permit heat transfer between a liquid beverage surrounding the main body and the frozen material contained within the interior chamber. A suction cup, fixed and integral with the bottom of the main body, permits removable attachment of the device to the inside base of a drinking vessel which is subsequently filled with the beverage. One or more flexible appendages connect between an outside rim of the suction cup and the main body to permit easy removal of the device from the drinking vessel by pushing the top of the main body in a side to side manner so that the one or more flexible appendages pull and lift on the outside rim of the suction cup, thereby compromising the vacuum seal between the suction cup and the drinking vessel and releasing the device.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
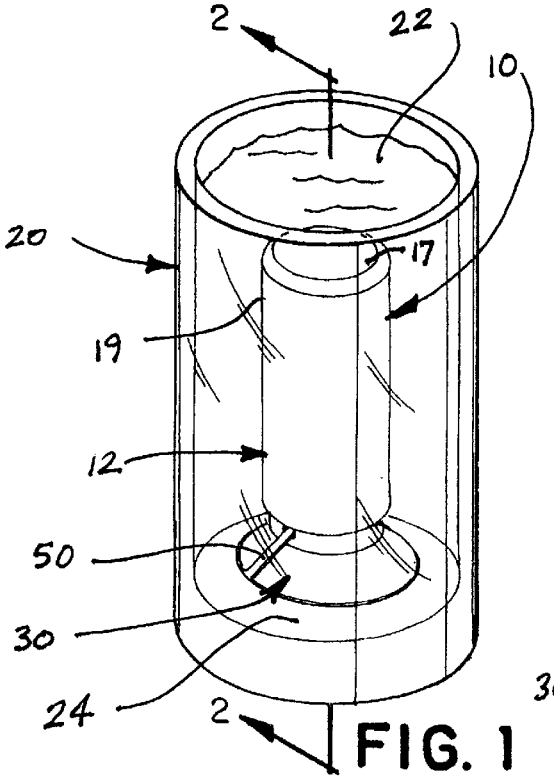
FIG. 1 is a front top perspective view showing the beverage cooling device installed within a drinking vessel for cooling a liquid beverage contained therein.
Figure 2:
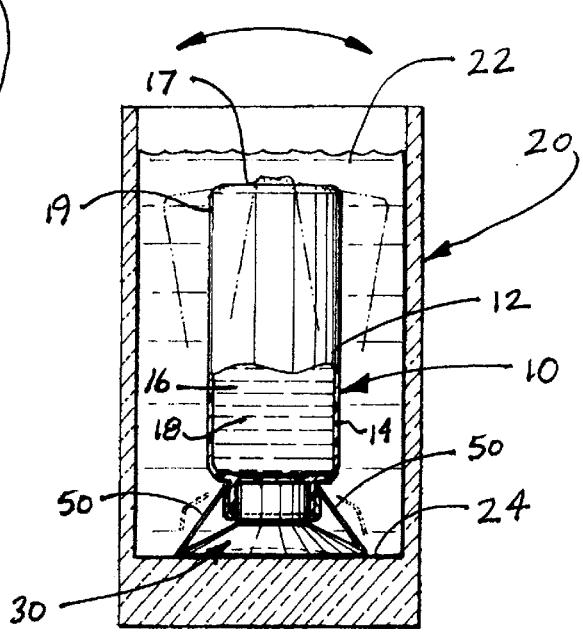
FIG. 2 is a cross-sectional view taken along the plane of the line 2—2 of FIG. 1.
Figure 3:
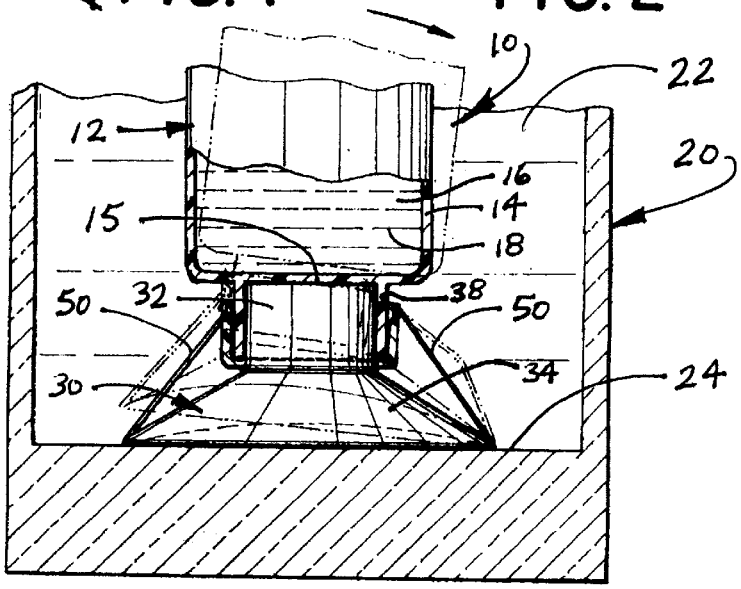
FIG. 3 is an isolated cross-sectional view taken from the lower portion of FIG. 2 illustrating release of a suction cup of the beverage cooling device from a bottom of the drinking vessel upon moving the upper body of the cooling device in a side-to-side and/or gyrating motion, as indicated by the arrows in FIGS. 2 and 3.

In the description which follows, like parts are indicated throughout the specification and drawings with the same reference numerals, respectively. The drawings are not necessarily to scale and the proportions of certain parts have been exaggerated to better illustrate operation of the invention.

Referring to the several views of the drawings, the beverage cooling device is shown and is generally indicated as 10. The beverage cooling device 10 is intended to be used for cooling a beverage 22 contained within a drinking vessel 20. The device 10 includes a main body 12 defined by an impermeable membrane wall 14 surrounding and encapsulating a sealed interior chamber 16 which is filled with a freezable liquid substance 18. The membrane wall 14 is specifically structured and disposed to permit heat transfer between the liquid beverage 22 surrounding the main body 12 and the frozen substance 18 contained within the interior chamber 16.

Figure 4:
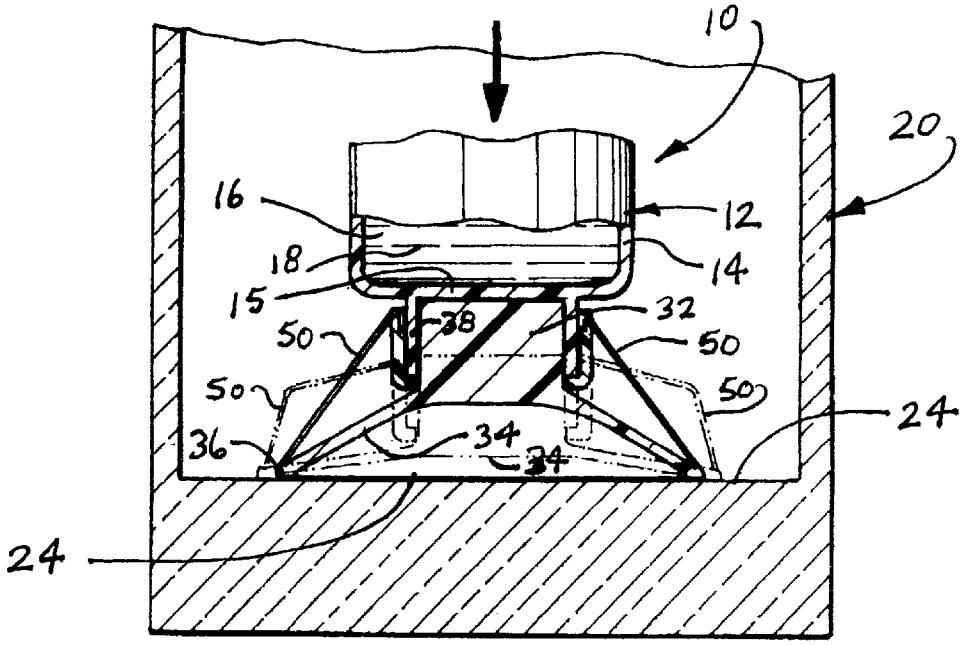
FIG. 4 is an isolated cross-sectional view taken from the lower portion of FIG. 2 showing attachment of the suction cup to the bottom of the drinking vessel upon applying a downward force on the beverage cooling device, as indicated by the arrow, thereby causing the suction cup to flatten and depressurize, so that a vacuum is formed between the bottom of the drinking vessel and the suction cup.
Figure 5:
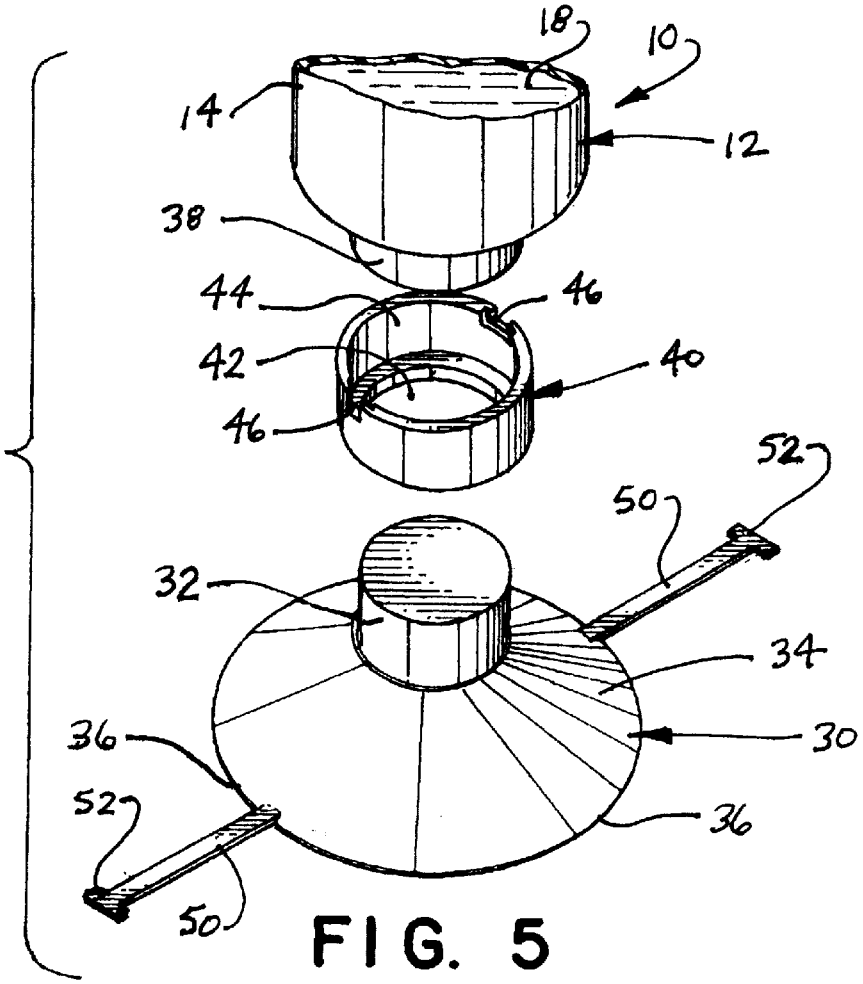
FIG. 5 is an isolated exploded view, shown in perspective, showing a cap member used for attaching the suction cup and appendages to a bottom neck portion of the main body of the device.

A suction cup 30 is permanently fixed to the bottom of the main body 12 for releasably securing the device 10 to an inside bottom surface 24 of the drinking vessel 20. In one preferred embodiment, a stem portion 32 of the suction cup 30 is press fit within a hollow neck 38 extending downwardly from the bottom of the main body 12 to provide a permanent attachment of the suction cup 30 to the main body 12. Alternatively, the stem portion 32 of the suction cup 30 can be bonded with the bottom 15 of the main body 12, or within the hollow neck portion 38, with the use of various well known bonding means including epoxy glues, heat bonding, or integral molding. In yet another embodiment, as shown in FIGS. 4 and 5, a retaining cap 40 is used as a means for attachment of the suction cup 30 and flexible appendages 50 to the main body 12, as described more fully hereinafter. And, while it is contemplated that the entire device 10, including the main body 12 and the suction cup 30, may be molded as one piece using the same material, it is preferable that the membrane wall structure 14 be of a more rigid material than the suction cup 30. The suction cup 30 further includes the cup portion 34 with an outer rim 36. The cup portion 34 is specifically structured and disposed for removable attachment to the inside base surface 24 of the drinking vessel 20.

One or flexible appendages 50 are connected between the outer rim 36 of the cup portion 34 and the main body 12. In a preferred embodiment, the one or more flexible appendages 50 are integral with and formed of the same material as the suction cup 30 and extend outwardly from the outer rim 36. The opposite end 52 of each of the one or more flexible appendages 50 is fixed to the lower portion of the main body 12. Attachment of the one or more flexible appendages 50 to the main body 12 may be achieved by various well known means. In one particular embodiment, the flexible appendages 50 are secured by means of glue bonding. In another embodiment, the flexible appendages 50 are secured to the main body 12 during the molding process. In another embodiment, shown in FIGS. 4 and 5, the end 52 of each flexible appendage 50 is enlarged, such as the top of a T, to facilitate attachment to a corresponding retaining structure formed on the main body 12 or attachable to the main body 12. In this particular embodiment, the retaining cap 40 is used as a means for attachment of the suction cup 30 and the flexible appendages 50 to the main body 12. Specifically, the retaining cap 40 includes a central hole or opening 42 which is sized and configured for snug fitted receipt of the stem portion 32 of the suction cup 30 therethrough. The retaining cap 40 further includes an annular collar 44 sized and configured for fitted receipt about the exterior surface of the hollow neck 38 of the main body 12. The retaining cap 40 and stem portion 32 can be permanently bonded to the hollow neck 38 and the bottom 15 of the main body 12 using suitable and well known adhesives such as, but not limited to, epoxy glues, heat bonding, silicone or the like. The annular collar 44 of the retaining cap 40 is provided with notches 46 to accommodate the respective T-shaped ends 52 of the flexible appendages 50 so that the ends 52 are captured between the annular collar 44 of the retaining cap 40 and the outer surface of the hollow neck 38 on the main body, as seen in FIG. 4. It should be noted that in this particular embodiment, the retaining cap 40 and stem portion 32 of the suction cup may further serve to plug an open bottom of the main body 12 after filling the liquid freezable substance 18 within the interior chamber 16 during manufacture of the device 10. The one or more flexible appendages 50 provide a means for breaking a vacuum seal between the portion 34 and the base surface 24 of the drinking vessel 20 so that the device 10 can be lifted up and removed from the drinking vessel 20. More specifically, the one or more flexible appendages 50 are structured and disposed to apply a lifting force on the outer rim 36 of the cup portion 34 to partially separate the cup portion 34 of the suction cup 30 from the bottom surface 24, thereby breaking the seal and releasing vacuum between the cup portion 34 and the surface 24 so that the device 10 can be lifted from the bottom surface 24 and removed from the vessel 20.

In use, the beverage cooling device 10 is first placed in a freezer of a conventional refrigerator. The freezable liquid substance 18 is chilled to a freezing point. When the substance 18 inside of the main body 12 is completely frozen, the beverage cooling device 10 is removed from the freezer. The device 10 can be used in combination with most any conventional cup, mug, drinking vessel, or the like. To secure the device within the vessel 20, a very small amount of a consumable beverage is poured into the drinking vessel 20 so that the liquid beverage 22 coats the inner bottom surface 24 of the vessel. The beverage cooling device 10 is then placed into the drinking vessel 20 and a downward force is applied to the top of the sealed main body 12, as indicated by the arrow in FIG. 4. The beverage on the bottom of the vessel will soften the frozen suction cup 30 and assist in attaching the cup portion 34 to the drinking vessel bottom 24. As the downward force is applied to the device 10, the cup portion 34 flattens and depressurizes, causing a vacuum to form between the bottom surface 24 of the drinking vessel 20 and the cup portion 34 as the flexible appendages 50 flex outward (see FIG. 4). At this point, the beverage cooling device 10 is securely attached to the base of the vessel.

To remove the beverage cooling device 10 from the bottom 24 of the drinking vessel 20, a manual force is exerted to the top end 17 or the upper portion of the side wall 19 of the sealed main body 12. More specifically, the sealed main body 12 is manipulated in a side to side motion and/or a twirling motion to cause the main body 12 to pull on the one or more flexible appendages 50 as the distance between the end 52 of a respective appendage 50 and the bottom surface 24 is caused to be increased. The flexible appendage is thereby caused to be pulled taught so that a lifting force is exerted on the outside rim 36 of the cup portion 34. The pressure will then equalize under the cup portion 34 causing the vacuum between the cup portion 34 and the bottom surface 24 to break. The cup portion 34 and remainder of the device are thereby released from the bottom of the drinking vessel 20.

The beverage cooling device 10 can then be removed from the drinking vessel 20 so that it can be properly washed by hand or by an automatic dishwasher and then replaced in the freezer until the next occasion for use.

While the instant invention has been shown and described in accordance with preferred and practical embodiments thereof, it is recognized that departures from the instant disclosure are contemplated within the spirit of the invention and, therefore, the scope of patent protection is not intended to be limited except as defined within the following claims as interpreted under the doctrine of equivalents.

What is claimed is:

1. A device for cooling a beverage in a vessel having an open top and an inner bottom surface, said device comprising:

a main body including an impermeable membrane wall surrounding and encapsulating a sealed interior, and said main body including a top portion and a bottom portion;

a freezable substance filled with in said interior chamber;

a suction cup fixed to said bottom portion of said main body for anchoring the device to the inner bottom surface of the vessel in a manner which permits the beverage to surround said impermeable membrane wall;

at least one flexible appendage extending and connecting between said main body and said suction cup, said at least one flexible appendage being structured and disposed to pull said suction cup away from the inner bottom surface of the vessel upon lateral movement of main body, thereby eliminating the vacuum between the suction cup and the inner bottom surface and releasing the device from anchored attachment to the inner bottom surface of the vessel; and said impermeable membrane wall being structured and disposed to permit heat transfer between the surrounding beverage and said freezable substance to thereby cool the temperature of the beverage contained within the vessel.

2. The device as recited in claim 1 thereby including said at least one flexible appendage extending and connecting between the said bottom portion of said main body and said suction cup, said at least one flexible appendage being structured and disposed to pull said suction cup away from the inner bottom surface of the vessel upon manipulation of said main body, thereby eliminating the vacuum between said suction cup and the inner bottom surface and releasing the device from attachment to the inner bottom surface of the vessel.

3. The device as recited in claim 2 wherein said flexible appendage includes a plurality of flexible appendages, each of said plurality of flexible appendages extending and connecting between the base area of said main body and said suction cup, and each of said plurality of flexible appendages being structured and disposed to pull said suction cup away from the inner bottom surface of the vessel upon said lateral movement of said main body, thereby eliminating the vacuum between said suction cup and said inner bottom surface and releasing the device from anchored attachment to the inner bottom surface of the vessel.

4. The device as recited in claim 1 in which side to side motion of the said main body would result in releasing said suction cup from the inner bottom surface of the vessel, thereby enabling removal of the device through the open top of the vessel.

* * * * *